US010179994B2

(12) United States Patent
Joynson

(10) Patent No.: US 10,179,994 B2
(45) Date of Patent: Jan. 15, 2019

(54) FLUID MOVEMENT DEVICE

(71) Applicant: Graeme Joynson, Withernsea (GB)

(72) Inventor: Graeme Joynson, Withernsea (GB)

( * ) Notice: Subject to any disclaimer, the term of this patent is extended or adjusted under 35 U.S.C. 154(b) by 266 days.

(21) Appl. No.: 14/890,286

(22) PCT Filed: May 15, 2014

(86) PCT No.: PCT/GB2014/000185

§ 371 (c)(1),
(2) Date: Nov. 10, 2015

(87) PCT Pub. No.: WO2014/184510

PCT Pub. Date: Nov. 20, 2014

(65) Prior Publication Data

US 2016/0115684 A1 Apr. 28, 2016

(30) Foreign Application Priority Data

May 15, 2013 (GB) ..... 1308731.7

(51) Int. Cl.
*F26B 7/00* (2006.01)
*E04B 1/70* (2006.01)
*F26B 21/00* (2006.01)

(52) U.S. Cl.
CPC ..... *E04B 1/7092* (2013.01); *F26B 21/004* (2013.01)

(58) Field of Classification Search
CPC .... F26B 3/02; F26B 3/04; F26B 23/10; E04B 1/7092
USPC .... 34/433, 87, 413, 414, 459, 463, 465, 487
See application file for complete search history.

(56) References Cited

U.S. PATENT DOCUMENTS 5,992,051 A * 11/1999 Salehibakhsh ..... F26B 21/004 15/309.1
8,567,088 B2 * 10/2013 Tritz ..... A01K 13/001 34/201
8,918,927 B1 * 12/2014 Smith ..... A47K 3/284 4/619
2005/0249632 A1 * 11/2005 Garrett ..... A22C 18/00 422/32
2005/0263043 A1 * 12/2005 Proudlove ..... B65D 19/0018 108/56.3
2006/0272176 A1 * 12/2006 Elliott ..... E04B 1/7069 34/523
2013/0318816 A1 * 12/2013 Thaler ..... B01J 8/1818 34/487

* cited by examiner

*Primary Examiner* — John McCormack
(74) *Attorney, Agent, or Firm* — William H. Bollman

(57) ABSTRACT

According to the present invention there is provided a fluid movement device suitable for drying adjacent surfaces such as floors, walls or ceilings or items such as furniture, in which the device comprises an inlet for receiving pressurised fluid, and at least one vent to direct said fluid towards said surfaces or items, and at least one pathway to allow escape of humid air generated through drying from the surface being dried to the surrounding environment.

19 Claims, 5 Drawing Sheets

FLUID MOVEMENT DEVICE

FIELD OF THE INVENTION

The present invention relates to a fluid movement device, more particularly but not exclusively a fluid movement device suitable for drying a surface in a controlled manner.

BACKGROUND

Excessive water in buildings causes primary damage for example due to wetting from a flood, escape of water or ingress of water. Further secondary damage can also occur resulting in further problems for example through growth of mould and onset of rot, tarnishing, corrosion caused by the moisture. In order to avoid such damage action should be taken to dry or remove excess water/moisture as soon as possible.

Typically the affected area may be heated and/or provided with dehumidifying means so as to enable drying. This can be timely and costly. Large scale drying such as due to flooding may be undertaken by specialist companies using industrial equipment; however drying can still take weeks or even months before reinstatement work can begin.

Often particular areas need to be targeted for drying, such as floor coverings or floorboards or concrete. Some specialist matting aids are used to target certain areas, however the mats must typically be secured in place and rely on pipe work which can be difficult to arrange and typically requires a suction/vacuum process.

Some methods of drying involve inflatable devices; however these can be liable to damage and therefore unsuitable for some situations. Other methods of drying require areas to be targeted to be isolated for example being enclosed in a tent or by sealing the building but such options may not always be viable, can be costly and may not significantly accelerate drying.

Often drying systems limit and/or restrict access to the area being dried therefore delaying other activities such as repair. Additionally many known prior art devices only allow escape for wet air at the periphery hence drying is therefore uneven and the devices may need to be moved round at intervals during the drying process thus adding additional steps to the drying process.

The present invention provides a constant supply of drying air across the drying area to accelerate and target drying in a controlled manner.

PRIOR ART

Accordingly a number of patent applications have been filed in an attempt to resolve the problem or similar, including the following:

United States patent application US 2010 192 400 (STORRER) discloses a surface drying system having a vacuum source comprising: a water-impermeable membrane having an upper side, a lower side, a perimeter, and a grid having passageways in fluid communication to the surface to be dried; and a port within the membrane and in fluid communication with the vacuum source, the port configured to allow water and air to pass from the grid to the vacuum source; wherein the vacuum source creates an enclosure of negative pressure within the perimeter of the membrane and urges water to flow through the passageways towards the vacuum source to effect moisture removal.

International patent application WO 2005 031 230 (FERNANDES et al) discloses a heating and drying system for heating and drying walls in a damp environment comprising: a wall system, said wall system further comprising: sheathing means for sheathing a wall surface, and air channelling means for channelling air along said wall surface; said wall system adapted to be attached to a wall surface; and a remote system, said remote system further comprising: ducting means for ducting air between said wall system and said remote system, blower means for forcing air through said system heating and drying system, dehumidifying means for removing moisture from air within said heating and drying system and expelling said moisture from said system, and heating means for heating air within said heating and drying system, said heating and drying system being a closed system.

United Kingdom patent GB 2 397 366 (ELLIOTT et al) discloses a drying device comprising opposed sheets of flexible material co-joined along peripheral edge portions thereof wherein at least one of the sheets is provided with a multiplicity of small apertures over its whole surface area, or substantially so, the drying device also comprising connector means for attachment of an air blower thereto, whereby, when the drying device is in use, air from an air blower is fed between said sheets and through said multiplicity of small apertures to remove moisture from a surface to be dried.

SUMMARY OF THE INVENTION

According to the present invention there is provided a fluid movement device suitable for drying a surface of an object, the device having at least one inlet through which a drying fluid flows into the device and at least one vent is arranged to direct the fluid from the device to the surface to be dried, wherein the device includes at least one pathway to allow fluid expelled through the at least one vent to move away from the surface of the object that is being dried.

In this way pressurised fluid, typically propelled air, is passed through the device, with the air being expelled through the vents and thereby directed at the surface to be dried such as a floor, wall or piece of furniture.

The flow of air at/across the area to be dried serves to displace moisture and accelerate evaporation which aids drying. Evaporation increases humidity of the air therefore it is important this humid air is able to escape from the surface being dried to the surrounding environment to accelerate drying and to prevent condensation forming about the vents or around the bottom face of the device which may delay drying. As a result of the pathways, for example as defined between fingers, humid air escapes quickly and without condensing, thereby removing the humid air from the surface being dried to the surrounding environment which further aids in accelerated drying.

Typically the air is forced from the vents as a jet of air directed towards the surface to be dried in order to accelerate evaporation. In this way the air disrupts the water molecules at the moist, damp or wet surface leading to rapid evaporation.

This form of targeted drying enabled by directing air at the surface to be dried is advantageous over standard methods of drying which use a dehumidifier and/or heater and/or fan in large spaces, as drying is accelerated by air being directed to wet or damp areas, rather than to some wet and some dry areas in the large void that forms the room enclosure. Therefore the damage to wet items or structures may be reduced as drying occurs more rapidly and selectively, additionally resulting in lower energy consumption to achieve these results.

The device is hollow defining a hollow chamber through which pressurised fluid passes by entering via an inlet and escaping through at least one vent.

In preferred embodiments the device is rigid to enable the device to tolerate pressurised fluid and so as to allow pressurised fluid to pass through the device without altering structure of the device.

Preferably the device is substantially cuboid having six faces so as to allow the device to be positioned on or against a surface.

In further embodiments the devices may be provided in different shapes in order to accommodate various locations that require drying. The device may be circular, triangular, hexagonal or any other multi-sided shape. For example a device may be adapted for fitting in a corner, such as where a floor joins a wall or for use in eaves. In such embodiments the device may have vents on more than one face in order to accommodate more than one surface to be dried and may have inlets and outlets arranged so as to correspond to adjacent devices.

In some other embodiments the device may be made to a bespoke shape to correspond to a specific space. For example a device may be shaped to fit a floor well in a vehicle, or a drawer in a piece of furniture.

Ideally the devices are formed from a strong, durable material so as to be suitable for repeated use. Preferably the devices may be formed from a lightweight material so as to be easily transported and to enable quick and easy arrangement of the devices in the area to be dried.

Ideally the devices are formed from a strong, durable, lightweight, heat and moisture resistant material such as synthetic plastic, for example polypropylene.

The devices may be manufactured through a moulding process such as by rotation moulding, injection moulding or blow moulding. Advantageously this may enable multiple, identical devices to be made.

In some embodiments the device may be formed as one single part. In some embodiments the device may include internal ribs, struts or supports to improve strength and to aid with manufacture.

The devices may be formed from multiple layers to provide improved strength and/or cost efficiency in manufacture, for example wherein the chamber is provided between two layers.

In preferred embodiments the device includes at least one outlet to allow exit of air from the device in addition to the vents.

Preferably the outlet provides an exit through which air can pass to another device thereby allowing flow of fluid through more than one device.

Typically the outlet is larger than the vent.

Ideally two or more devices are capable of being connected one to another so as to provide a network of devices covering a larger area.

In preferred embodiments at least two devices are connected or concatenated, such that the outlet of a first device connects to the inlet of a second device. In this way two devices are joined so that air can pass from one device to another without loss of air from the system.

Preferably all inlets are located on the device sides enabling one device to be attached to another, side by side. Additionally this enables the devices to be arranged in a planar and sequential manner in use over a larger surface area such as to cover a floor.

In preferred embodiments more than one inlet may be provided on each device, typically on plural sides of the body.

In some embodiments the inlets comprise inter-engaging parts so that one inlet can form a connection to another inlet or outlet without requirement for additional connecting parts. Preferably the inlets may include lips so as to enable the inlets to mate.

In some embodiments said lips may be flexible, for example being formed from a resiliently deformable material such as rubber, so as to enable the removal of one device from a network arrangement without requirement to disrupt all surrounding devices. In this way the surface being dried can be readily checked and/or monitored by displacement of one or more devices.

Alternatively or additionally two or more devices may be joined by a push fitting system so as to avoid having to twist or rearrange the device in any way to enable connection. Therefore the devices can be laid out in the area to be dried and then pushed together so as to be connected to form an interconnected network.

Typically the inlets and outlets are circular so as to readily connect, for example wherein the male inlet/outlet is accepted into the female inlet/outlet.

In other embodiments the inlets or outlets may not be circular for example being square, rectangular, oval shaped or other corresponding shape.

Ideally the female inlet/outlet may have a diameter greater than 100 mm and the male inlet/outlet may have a diameter less than 100 mm therefore they can readily be joined. Advantageously the male and female inlets are designed to fit snugly so as to reduce or minimise escape of air about the connection.

Advantageously circular inlets are also well-suited to readily accept ducting, piping, or trunking in order that pressurised fluid may be readily fed through the inlet/outlet.

It may be envisaged that in some embodiments the inlets/outlets may be provided with adaptors and/or clips or other mechanical clamping means so as to be able to accept and maintain in place accepted ducting, piping or trunking of different sizes.

Preferably a means connects to an inlet of one device so as to adapt the inlet to receive an outlet from another device in order to minimise or prevent loss of air between a cooperating inlet the outlet. For example the inlet may accept an O-ring, a collar or cuff so as to provide a tight, concentric, sealed fit to the outlet.

Advantageously the means may be universal so as to be suitable for connecting: an inlet to an outlet; two inlets; two outlets and/or an inlet or outlet to a pressurised fluid supply. For example the inlet on one device may be attached to an inlet on another device, or the outlet of one device may be attached to the outlet of another device, in order that inlets equally function as exit outlets or vice versa.

In this way the device is adapted to permit flow of air through the device and on to another allowing exit of air through vents and inlet/outlets.

For example a cuboid device may include at least one inlet/outlet on any of the four sides, so as to permit connection to other devices on each side. In this way the area over which the devices are arranged can be incrementally increased, for example so as to cover a strip such as a hallway, or an entire floor of a building to be dried.

In some embodiments vents, inlets and outlets may be provided in specific locations on the device to permit fitting of devices in irregular or unusually shaped areas such as corners, eaves, roof spaces or foot wells. For example vents, inlets or outlets may be provided on corners of the device.

In further embodiments a means such as a clip is provided to connect inlets/outlets in order to ensure that high pressure fluid does not dislodge the connection.

In some embodiments radial slots, resiliently deformable material, members or ribs, or other mechanical means, may be included to allow deformation during connection wherein said means may permit mutual engagement.

In some embodiments the devices may include interlocking portions, arranged on external faces of the device such that devices can be slotted together and as a consequence the inlets aligned or held proximate each other. In yet further embodiments connection may be accomplished or initiated by magnetic sections or hook and loop portions, such as Velcro(RTM).

In preferred embodiments the vents are provided on a face of the device that interfaces the surface to be dried. Inlets and outlets are typically provided on any other face. For example the vents may be provided on a bottom face with any inlets and outlets being provided on side faces of the device. In this way a network of connected devices may be arranged across a floor or against wall so as to have all vents directed to the surface to be dried and outlets and inlets arranged to correspond with adjacent devices in order to facilitate constant flow of drying air throughout the network of connected devices.

Preferably an upper surface of the device is flat having no vents, inlets or outlets. Advantageously this allows the devices to be walked upon if for example arranged on flooring so that the room may be used and/or accessed during the drying process. In this way devices may be conjoined to provide a network of devices that form a superior usable surface over the subordinate surface to be dried. The superior surface is preferably cable of weight bearing for instance to support a user's weight or the weight of drying equipment.

In this way the drying process does not inhibit other activities, such as repair or maintenance, or for storage of equipment or furniture. This also allows the devices to be walked over during fitting so that the devices can be fitted closely together without having to leave spaces, for example for a user's feet, or for a supporting structure for a user such as scaffold, or other access equipment, with appropriate over-boarding to be provided Ideally the upper face of the device may be textured so as to provide anti slip means. For example the textured face may include raised and lowered portions, or include a resiliently deformable material such as rubber to provide grip.

The pressurised fluid may be ambient air pressurised by means of a pump, blower or fan, hereon in referred to as a pressurised fluid source. In this way air is forced into the device and thereby forced from the device through openings such as the vents, inlets or outlets.

Advantageously the pressurised fluid may comprise air that is heated and/or dehumidified so as to further aid drying. For example the pressurised fluid source may include a blower with a heating element so as to also heat the air. Additionally the pressurised fluid source may include dehumidifying means. It may be envisaged that that the pressurised fluid source may include separate or integrated elements to enable fluid to be pressurised, heated and/or dehumidified. Preferably the elements can be controlled separately so as to select temperature, pressure and humidity.

The pressurised fluid that is produced for the drying process is ideally piped to the device inlet by means of ducting. In this way the pressurised fluid source may be arranged a distance from the device, for example being away from the wet/damp surface. Ideally the ducting is flexible so as to readily accommodate the location in which drying is required, for example passing over or around objects.

Preferably the ducting is compatible with the inlets or capable of being connected to the device by the adaptor so as to allow easy, quick fitting of the ducting to the device.

In some embodiments ducting may be used between devices, passing pressurised fluid from one device to another. Advantageously this may permit angled interconnections and arrangements of devices for example to accommodate an irregular space of a fixed object such as a beam or pillar, or enable the devices to extend into two or more different rooms whilst remaining as one network or a group of networks.

In some alternative embodiments such ducting may be rigid and enabling of variant fixed arrangements of devices, or include a combination of rigid and flexible ducting.

Advantageously any dehumidifier provided as part of the pressured fluid source also functions to extract moisture from surrounding air therefore ensuring that moisture is extracted from the air during the drying process.

More than one pressurised fluid source may be used to increase airflow or pressure within a device, or within a network of devices. Furthermore the pressurised fluid sources may be arranged at a plurality of locations within the network in order to aid with providing a desirable equal pressure through the network and/or to position the pressurised fluid sourced in the most suitable locations, such as near to power supplies.

In this way the speed of drying may be controlled by pressure and temperature of the air forced through the devices in use and the device's internal volume. Therefore a user is able to select the most desirable parameters for the surface or item to be dried. Additionally the parameters can be changed during the drying process.

Advantageously this enables drying to be carried out in a controlled manner so as to control temperatures, rate of flow, pressures and humidity. This enables rate of drying to be controlled in order to enable drying at a particular rate that may be beneficial to some materials, such as wood, so as to prevent or limit warping. Additionally in this way more delicate items could be subjected to slower drying or drying at varied rates, for example wool based carpets, paper or silk curtains that may be adversely affected by rapid drying.

In preferred embodiments said surface(s) is/are situated in use subordinate the device. For example the device may be arranged against a floor, wall or ceiling that requires drying.

Typically a face of the device directed to the surface includes at least one vent so as to allow exist of the air towards the surface to be dried. In this way specific areas can be targeted. Advantageously this can provide greater efficiently during drying by only targeting the wet or damp area.

Preferably the face of the device directed to the surface includes a plurality of vents dispersed across the face. In this way air can be dispersed across a larger surface area to promote even drying.

Typically the vents may be arranged regularly over the face directed to the surface to be dried for example in rows or a grid. In some other embodiments the vents may be irregularly spaced and/or may be arranged to correspond to a particular surface. For example a line of vents may be provided to correspond with a join in flooring.

The pathway(s) provided in the device traverse the device so as to allow passage of pressurised fluid from the surface being dried to the surrounding environment, for example the area above the devices. The pathway may be an aperture, channel or path defined in the device which passes from a vented face to another face, preferably an opposing face.

In preferred embodiments the pathway may be defined by fingers projecting on one or more sides of the device wherein a gap between each finger defines a pathway in order to allow airflow from the vents away from the device via the pathway.

Advantageously the humid air generated during evaporation from the surface being dried is able to circulate along/through the pathway and thereby away from the device(s) rather than being trapped around vents. Thus wet/humid air is constantly being replaced by dry air. This therefore reduces likelihood of the humid air condensing on the device(s) and/or against the surface being dried or from being circulated instead of vented which would inhibit drying.

In preferred embodiments the pathway(s) is/are minimal relative to the device. For example the pathway may be a narrow slot provided between two fingers having a cumulative cross sectional area greater than that of an inlet/outlet so as to minimise any back pressure to the device.

In preferred embodiments the dimensions of the pathway(s) may be less than 50 mm and ideally less than 30 mm between the fingers so as to maximise the devices internal volume and for creating an optimal micro-climate in which accelerated drying is encouraged, but still providing an escape route for the humid air. Advantageously these dimensions are such that a user can safely walk atop the devices without risk of a foot slipping into the pathway.

In other embodiments the dimensions of the slots or pathways may be more than 50 mm, for example in larger devices.

Advantageously as drying is accelerated associated energy consumption is reduced and time taken for drying may also be reduced.

Advantageously the pathways may also provide improved strength by providing greater perimeter length and therefore enhance the devices weight bearing capabilities.

Preferably the device is adapted to tolerate a force in excess of 10N, preferably in excess of 50N, most preferably in excess of 100N across its upper surface. Ideally the device is capable of receiving a load at/on any part of the device.

Ideally any inlets or outlets not connected to another device or to an air supply are sealed by a cap so as to prevent escape of fluid during drying. Preferably the caps may be removably connected by snap fitting, friction fittings, screw or twist fitting or detent mechanism.

In some other embodiments the method used to connect the devices together may include or be fitted with a non return device such as a flap valve that is closed when not connected to another device thus preventing airflow, or opened upon connection to another device thus allowing airflow between the devices. In this way the cap(s) may be integrated with the device so that there is less chance of losing or misplacing the caps.

In preferred embodiments a double-sided cap may be provided with a male means of attachment on one side and a female means of attachment on the other side in order to accommodate all inlets/outlets. In this way any cap may be used on any inlet/outlet by engaging the appropriate side. Typically the male side of the cap is located in use within the inlet/outlet and may include a finger grip so as to enable it to be readily removed from within the inlet/outlet when not required. The female side of the cap instead receives the inlet/outlet and can be readily gripped and removed and may not require finger grips.

In preferred embodiments the device may include feet that raise the device from surface upon which it is placed to further enhance circulation of air around the device and therefore aid rapid drying by purposefully creating a void between the face housing the vents, and the surface to be dried thus creating a drying micro climate.

In some embodiments the feet may be adjustable, so as to alter elevation of the device from the surface, thereby adjusting size of the area in which the micro-climate is formed. Advantageously this may also allow the devices to be levelled in order to provide a flat upper face for walking on, even if the surface itself is uneven. For example the feet may be mounted on a thread so that feet can be moved up and down the thread by twisting the foot.

Furthermore the feet are typically dimensioned so as to allow the devices to be stackable wherein the device has an upper face that is also adapted to receive the feet of an ordinate device so that one device may be positioned on another for transportation or storage when not in use. Typically the upper face of the device may be chamfered or tapered so as to receive the feet of a device arranged thereupon.

In use the devices may be arranged to form a structure such as an over-arching carcass or box with plural vents facing inwards, in which items such as furniture may be placed in order to be dried.

Additionally the devices can be arranged in opposing and parallel fashion spaced apart, with one layer of devices inverted with the plural vents facing the wet surfaces, so that planar items such as carpets, screens or rugs can be sandwiched between the devices to facilitate rapid drying.

It may be envisaged that in some situations a means of ventilation may be provided in an area being dried so as to allow humid air to be passed away from and possibly outside of the drying environment, for example out of a building. For example an extractor fan may be provided to funnel humid air from within a building to outside of a building.

In some embodiments the devices are stackable with joinable or interlocking features in both vertical and horizontal planes so as to enable the devices to be readily stowed and transported and moved around a room as required and as a unit.

It may be envisaged that where the devices are used to dry walls and ceilings a prop or plurality of props or other supporting means may be provided to support the devices in order to facilitate drying at an elevated position with stability.

In some embodiments brackets may be provided for ceilings so that the devices may be suspended therefore keeping the space below clear, rather than being cluttered with props.

The device can be provided in a plurality of sizes dependant on the surface or item to be dried. For example the device may be provided having different volumes or dimensions.

It may be envisaged that in some embodiments the device may be used to provide a targeted micro climate to facilitate the evaporation of substances other than water. For example the devices may be used to dry chemical spillages.

Typically the device is used as park of a system comprising more than one device and at least one pressurise air source therefore enabling airflow to be passed from one device to another and thereby enabling air to be expelled over a greater area.

The device may be provided as part of a modular kit comprising a plurality of devices and at least one pressurised fluid source.

Preferred embodiments of the invention will now be described, by way of example and with reference to the Figures in which:

DETAILED DESCRIPTION OF FIGURES

Figure 1A:
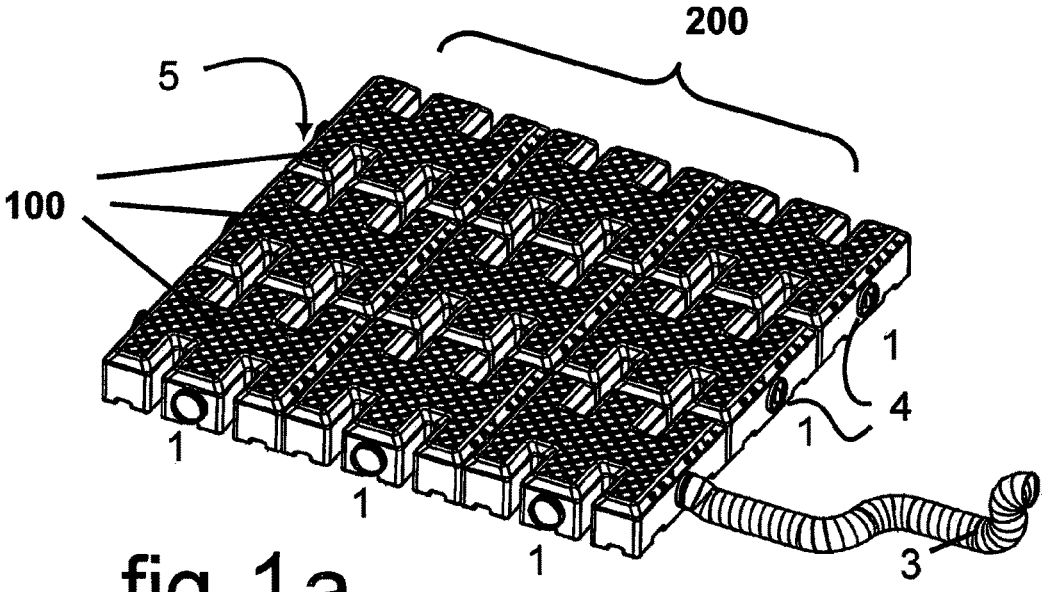
FIG. 1A shows an isometric view of nine devices, according to one embodiment, shown interconnected as an array, matrix or network.

Referring now to FIGS. 1 to 5, which show various views of a preferred embodiment of the device. Each device 100 is substantially rectangular and is in the form of a central, hollow, rectangular box. The bottom face is placed, in use against a surface to be dried or desiccated. Three pairs of fingers 10 extend symmetrically from opposite sides of the hollow box, from a forward position 10*a* and 10*b;* from an intermediate position 10*c* and 10*d;* and from a rearward position 10*e* and 10*f* (shown in FIG. 3). The central hollow box and the fingers 10 are all hollow and serve to define pathways 15. The device 100 is typically formed by an injection moulding, blow moulding or rotational moulding process.

Devices 100 are formed from a rigid synthetic plastics material, such as polythene or polypropylene and the fingers 10 are of equal size and shape.

Suitable connection means are provided so as to enable devices 100 to be connected, one to another, as described in detail below.

An upper face 5 of the device 100 is textured, or otherwise formed with raised and lowered regions to provide grip underfoot, so that a user can walk across the surface with reduced risk of slipping, even if surfaces are wet/damp.

At one or more face of the device 100 there is provided one or more inlet/outlets 1 through which pressurised air can pass. These inlets/outlets 1 are formed in locations such that when one device 100 is placed adjacent another device 100, as can be seen for example in FIG. 1A, air can flow from one device to an adjacent interconnected device 100.

Each device 100 includes a plurality of feet 6 that serve to elevate the device 100 from a surface (not shown) against or on which it is arranged in order to allow circulation of air in a micro-climate as defined by the space between the face of the device 100 directed to the surface and the surface. Feet 6 are so formed as to enable devices 100 to be stacked when not in use, as upper surface 5 of a device is chamfered or tapered so as to receive feet of a second device placed thereon. In this way the devices 100 can be easily stacked for stowage or transportation and are prevented from toppling in transit/storage.

FIG. 1A shows an array, matrix or network of nine devices 100 arranged adjacent one to another so as to extend over a rectangular area. A length of flexible ducting 3 is connected to one inlet 1 in order to pipe a supply of pressurised air from a pressurised air source (not shown).

A plurality of vents 20 (not shown in FIG. 1A) are provided on a bottom face 7 of the devices (not shown in FIG. 1A) that allow air to be directed towards the surface to be dried.

Figure 1B:
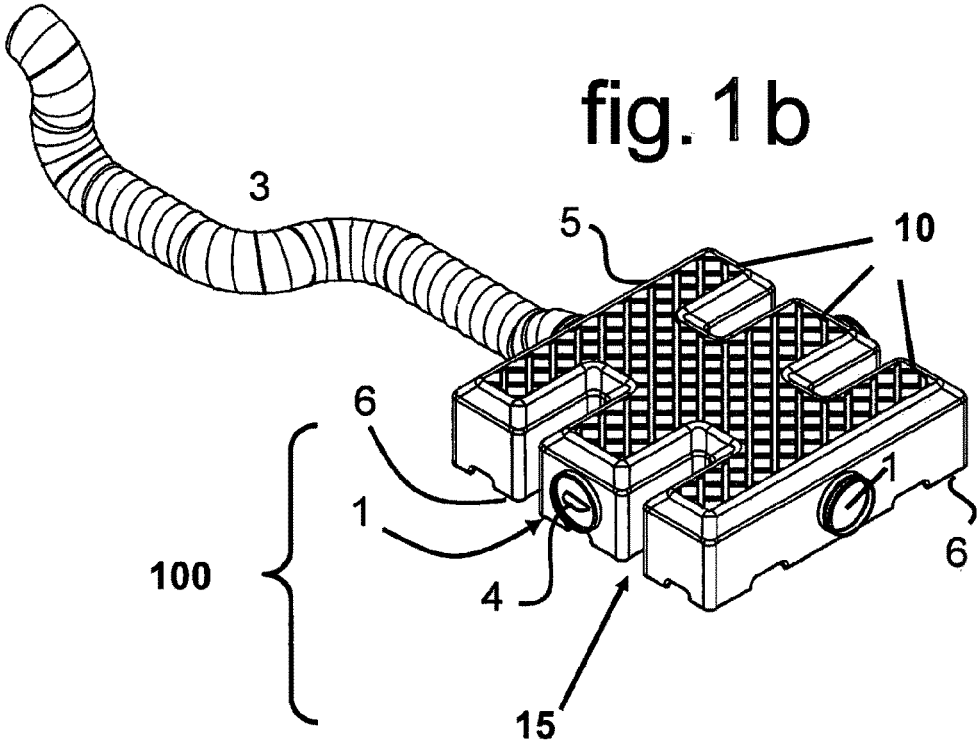
FIG. 1B shows an isometric view of one embodiment of the devices, shown in FIG. 1A, with a piece of ducting connected to the device.

FIG. 1B shows a single device 100 connected to a length of ducting 3. The inlet/outlet 1 is shown provided on central finger 10*c*, 10*d*. The inlet/outlet 1 has a cap 4 which serves to close the inlet/outlet when not connected to another device, therefore preventing flow of air through that particular inlet/outlet.

Devices are typically about 600 mm (wide)×500 mm (long)×150 mm (high). In this embodiment, devices 100 can be stacked and arranged in multiple layers, 2×2 on a standard pallet for storage and transportation. The upper face 5 of the device 100 has chamfered edges so as to allow the devices 100 to be stacked one atop another so that the feet fit about the chamfered edges.

The vents 20 (shown in FIG. 3) are less than 20 mm and ideally less than 10 mm so that pressurised air is forced from the device as jets of air. Vent sizes are variable according to the application and severity of wetness/dampness to be treated, for different devices, systems and uses. For example vent sizes may be variable depending upon saturation. Another reason why vent sizes may be varied is to accommodate different pressures, different surface textures/profiles that require drying and/or different items to be dried. Additionally in some embodiments the vents may be shaped, for example by being tapered or rifled or fitted with a means to direct airflow or cause air to flow in a particular way, so as to accelerate drying.

Figure 2A:
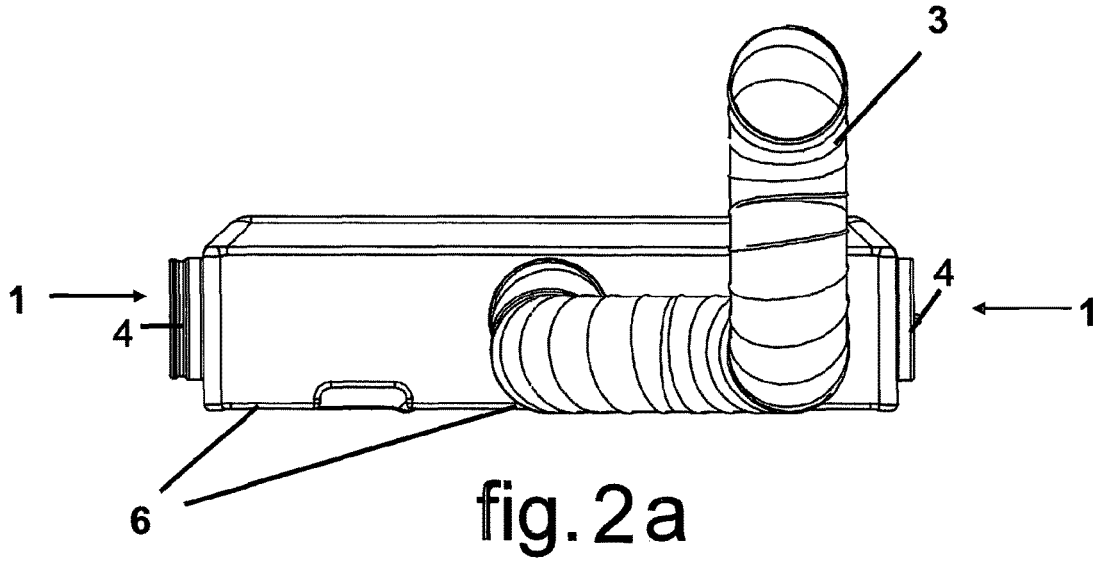
FIG. 2A shows a side view of one of the nine devices, shown in FIG. 1A, connected to ducting at a centrally located aperture.
Figure 2B:
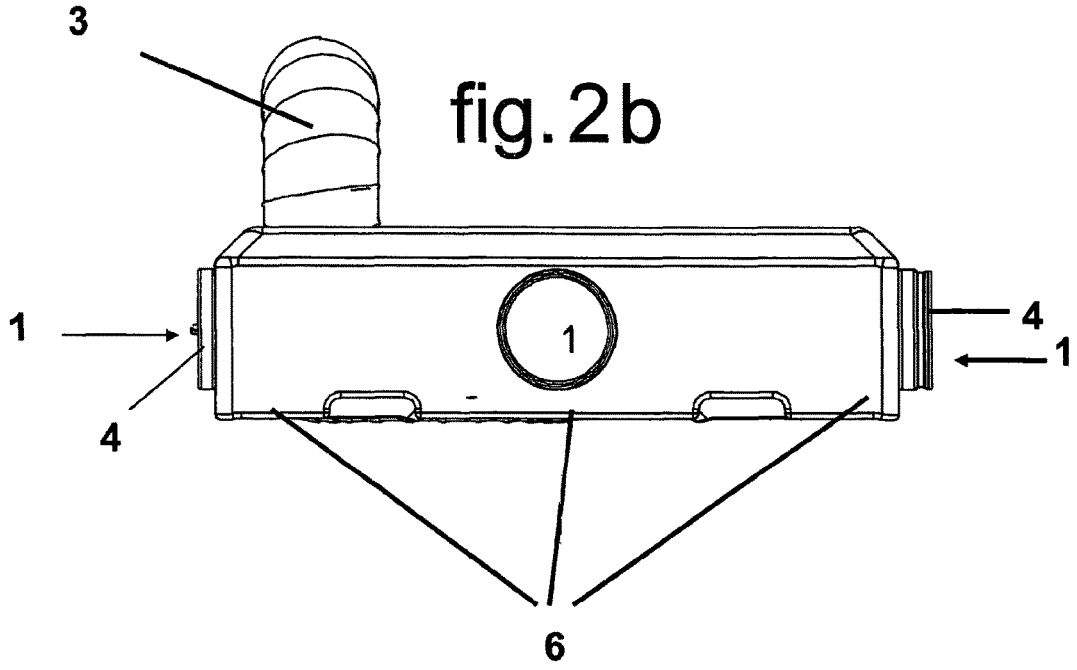
FIG. 2B shows an alternative side view of the embodiment of the device, shown in FIG. 1A, and shows ducting connected to an aperture located at an end of a face.

FIGS. 2A and 2B show side views of a single device connected to ducting 3 as can be seen in FIG. 1B. The feet 6 are arranged at each corner of the device and at a mid-point on each device. This configuration of feet provides strong support for the device to ensure that the bottom face 7, in which vents 20 are formed, remains elevated from the surface even during weight bearing.

Figure 3:
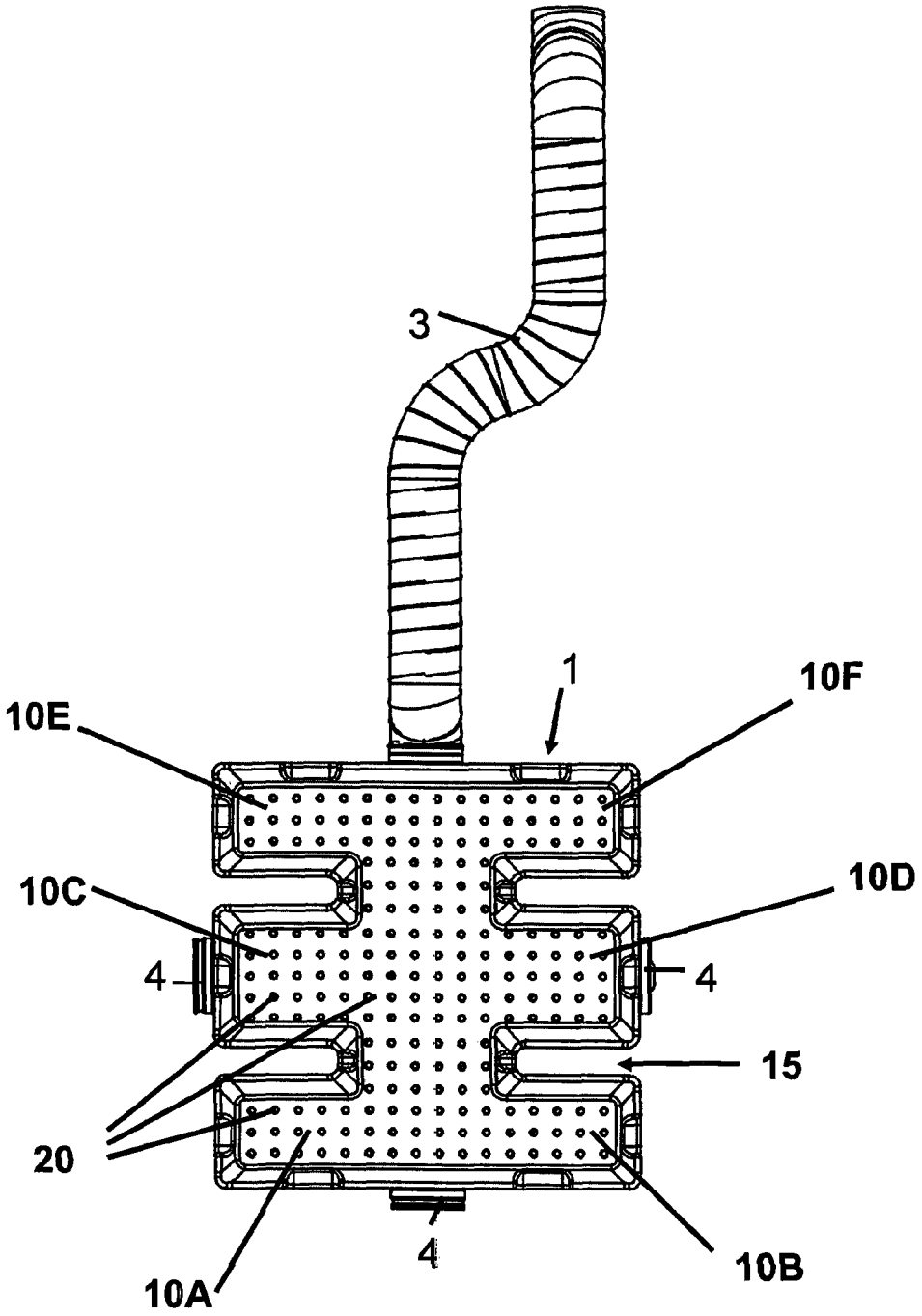
FIG. 3 shows an underside view of the embodiment of the device, shown in Figure and ducting and as shown in FIG. 1B.

FIG. 3 shows an underside view of a single device connected to a length of flexible ducting 3 at one inlet/outlet 1. The further three inlet/outlets, one arranged on each of the other three sides of the device 100 are sealed by caps 4. Therefore pressurised fluid can only escape through the vents 20.

The bottom face 7 of the device 100 includes a plurality of vents 20 that allow air to be released towards the surface to be dried. The vents 20 are regularly spaced across the bottom face 7 of the device 100 in a grid formation.

Figure 4:
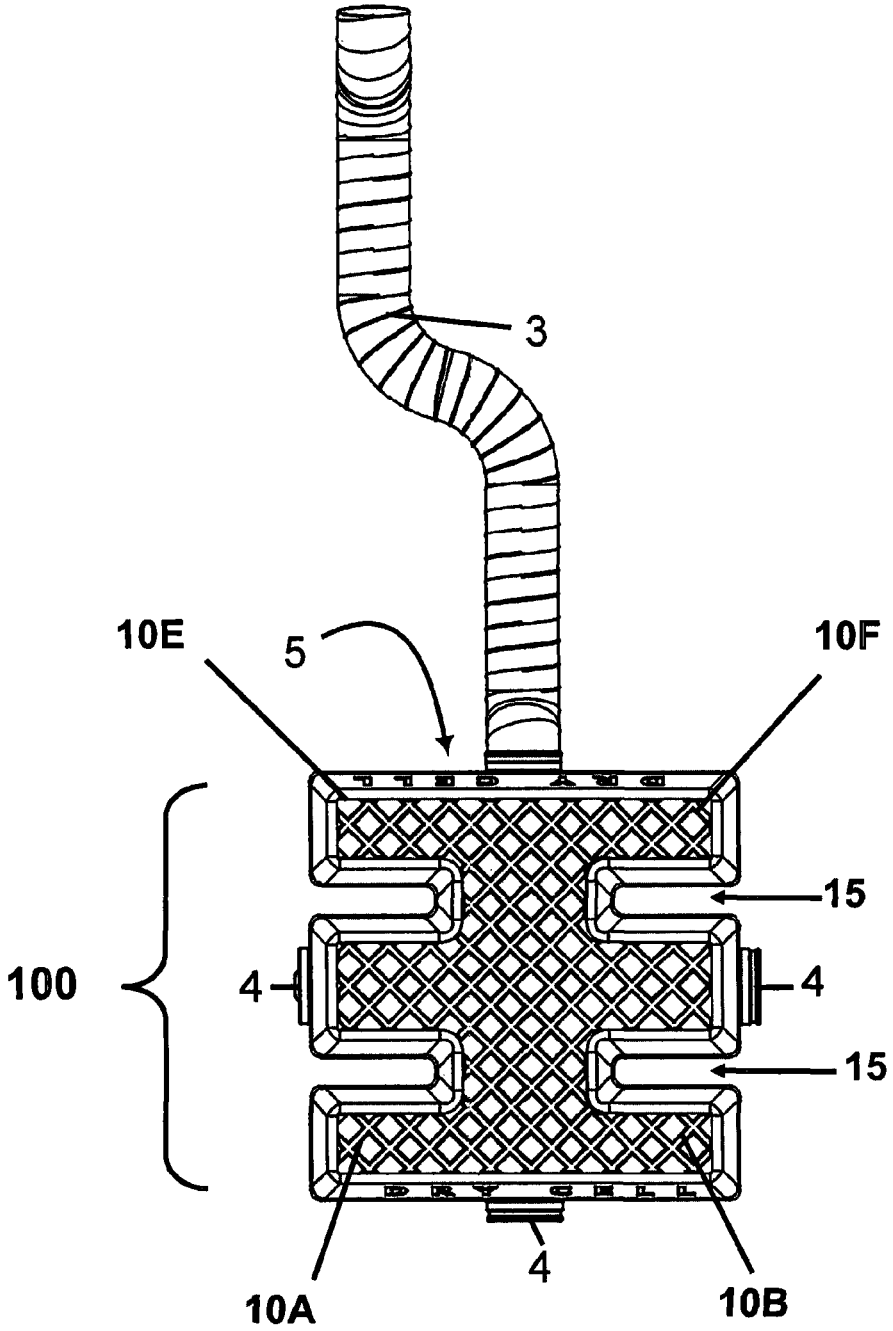
FIG. 4 shows a top view of the embodiment of the device and ducting and as shown in FIG. 1.

FIG. 4 shows a top view of the device 100 as shown in FIG. 3. The upper face of the device 5 includes a cross hatched raised and lowered surface for enhanced grip.

Figure 5:
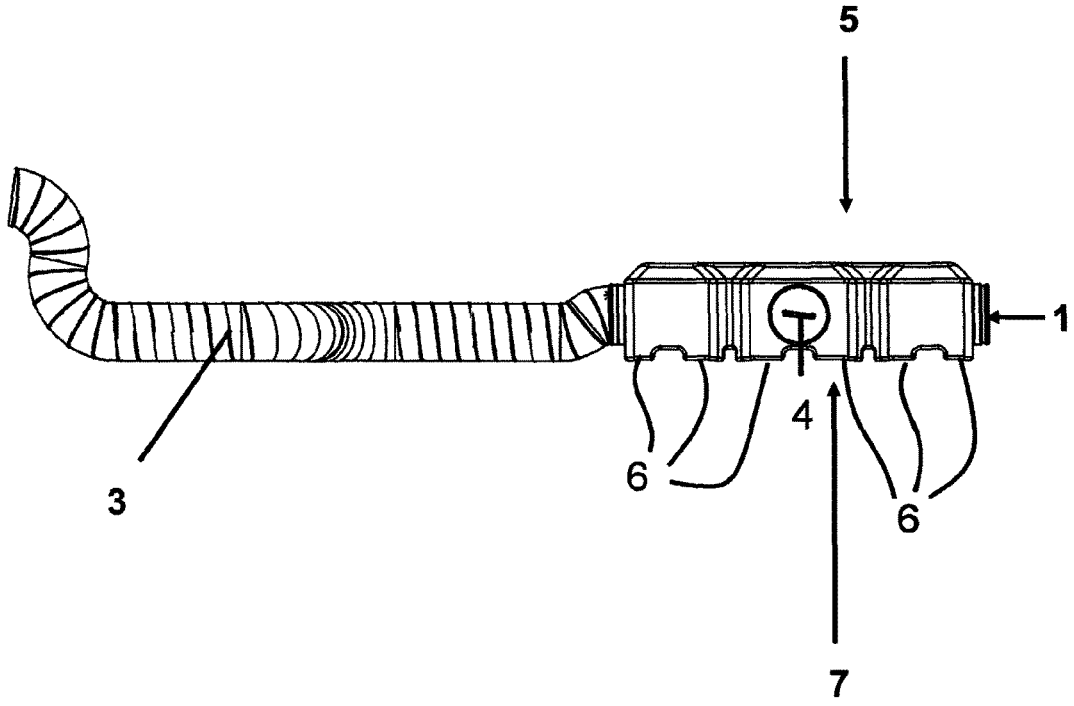
FIG. 5 shows a side view of the embodiment of the device and ducting and as shown in FIG. 1.

FIG. 5 shows a side view of the device as shown in FIGS. 3 and 4. The device 100 has a foot 6 at each corner of each finger 10.

It may be envisaged that in some embodiments various sized or shaped bodies may be provided so as to accommodate different structures or objects so that they can be used beneath kitchen units and unusually shaped furniture, rooms or enclosures.

The device will now be described briefly in operation and when connected to a source (not shown) of dry and/or heated air.

A device or plurality of devices is laid upon or positioned against a surface wherein the bottom face 7 of the device 100 has vents 20 directed towards the surface to be dried. For example a network of nine devices 200 (as shown in FIG. 1A) may be laid across a floor, with the bottom face 7 against the floor. Each device 100 in the network 200 is connected to an adjacent device by means of an inlet/outlet 1. In this way air within one device is free to pass through the inlet/outlet to another connected device.

At least one inlet 1 arranged on a periphery of the network, and therefore not attached to another device, is connected to a length of ducting 3 which is connected to a pressurised air source (not shown), such as a blower with heating means. In this way when the blower is activated heated air is forced along the ducting 3 from the blower into the device 100 to which the ducting 3 is attached via the inlet 1.

The hollow chamber of the device 100 becomes filled with pressurised, heated air which escapes from the device 100 through vents 20 directed towards the surface to be dried, and through inlets/outlets 1. In this way heated, drying air is released over the area covered by the network 200 through the vents 20.

As the inlets/outlets 1 are larger than the vents 20 air passes more freely to other devices first so that the network 200 becomes pressurised and thereby allowing an even release of forced air through the vents 20 to be generated across the network 200.

The space between the device face interfacing the surface to be dried 7 and the surface itself is determined by size of the feet 6. For example foot height determines elevation of the device from the surface and therefore the area in which the micro-climate is formed.

Air is forced from the vents at the area to be dried causing moisture from the surface to evaporate creating humid air. Continued release of pressurised air from the vents 20 encourages humid air to be forced from the micro-climate beneath the device 100 along the pathways 15 to the surrounding environment.

Ideally a dehumidifier may be included as part of the drying process to extract moisture from the surrounding environment.

The blower may be adjusted in order to alter force of air flow. This in turn alters pressure within the device (s) and force at which air is expelled through the vents 20. In some drying systems when a number of devices are used over a large area a number of pressurised air sources may be provided at different locations across the network.

The invention has been described by way of examples only and it will be appreciated that variation may be made to the above-mentioned embodiments without departing from the scope of invention. It is also understood that inlets, when suitably modified, may operate as outlets in dependence upon the direction of flow of air and the intention of a user.

Therefore, the foregoing is considered as illustrative only of the principles of the invention. Further, since numerous modifications and changes will readily occur to those skilled in the art, it is not desired to limit the invention to the exact construction and operation shown and described, and accordingly, suitable modifications and equivalents are considered to fall within the scope of the claims appended hereto.

The invention claimed is:

1. A device for drying a surface, the device comprises:

a rigid body defining a chamber for receiving drying fluid is arranged to be placed against the surface and to direct a drying fluid past the surface to be dried, the body comprising:

at least one inlet adapted to receive a current of drying fluid and at least one outlet for outputting drying fluid directly to an adjoining second device, the at least one inlet being adapted for selectable connection to either a flexible ducting to supply the current of drying fluid or the at least one outlet of an adjoining third device;

at least one vent through which drying fluid vents towards the surface to be dried;

at least one foot so as to space the body from the surface to be dried in order to accelerate evaporation, and a matching foot-receiving shape on an opposite surface of the body to receive a bottom of the at least one foot of another device stacked thereon;

a textured upper face on the body to provide grip underfoot, so that a user can walk across an upper surface of the body with reduced risk of slipping on a wet surface, and a pathway that traverses the body to permit escape of humid air from the surface to be dried.

2. A device according to claim 1 wherein at least nine of the devices are capable of connection by parts adapted to mate one with another.

3. A device according to claim 1 wherein a plurality of the devices are capable of connection by hook and loop means.

4. A device according to claim 1 wherein a plurality of the devices are capable of connection by magnetic means.

5. A device according to claim 1 wherein the body comprises a hollow body formed from a single mould.

6. A device according to claim 1 wherein the body is substantially cuboid in form.

7. A device according to claim 1 wherein the device is substantially rectangular in section.

8. A device according to claim 1 wherein the body is shaped to correspond to an area to be dried.

9. A device according to claim 1 is adapted to be weight bearing to tolerate a force in excess of 100N.

10. A device according to claim 1 wherein the device includes interlock portions to lock one device to another.

11. A device according to claim 1 includes ducting provided to connect and direct fluid to/from the at least one inlet or the at least one outlet.

12. A device according to claim 1 wherein a cap is provided for selectively closing the at least one inlet or the at least one outlet.

13. A system having a plurality of devices interconnected inlet to outlet as claimed in claim 1.

14. A system according to claim 13 including a pressurised fluid source.

15. A system according to claim 13 including a heater.

16. A system according to claim 13 including a dehumidifier.

17. A method of using the device as claimed in the system according to claim 13 including the steps of:

positioning the plurality of devices adjacent the surface to be dried, connecting the plurality of devices to a source of propelled fluid by the at least one inlet of a first one of the plurality of devices, so as force flow of fluid from the respective body of each of the devices via the vents onto a wet surface whereby humidity of the fluid is raised as a result of evaporation of moisture from the surface to be dried, the evaporated moisture thereafter moving through the pathways away from the surface to be dried to a region of lower humidity.

18. A method of using the system according to claim 13 including the steps of:

arranging at least two devices opposed and parallel one to another;

providing a volume for sandwiching an object between the devices, the at least one vent of each of the devices being directed towards the object, so that planar items such as carpets, screens or rugs can be rapidly dried on both planar faces wherein evaporated moisture moves away from each of the devices through the respective pathways.

19. A method of using the system according to claim 13 including the steps of:

arranging more than two of the devices to form a structure with each of the respective at least one vent facing inwards towards an item.

* * * * *